US007187287B2

(12) United States Patent
Ryal

(10) Patent No.: US 7,187,287 B2
(45) Date of Patent: Mar. 6, 2007

(54) SYSTEMS AND METHODS FOR ZONE SECURITY

(75) Inventor: Kim Annon Ryal, Mason, MI (US)

(73) Assignees: Sony Corporation, Tokyo (JP); Sony Electronics, Inc., Park Ridge, NJ (US)

( * ) Notice: Subject to any disclaimer, the term of this patent is extended or adjusted under 35 U.S.C. 154(b) by 285 days.

(21) Appl. No.: 10/901,489

(22) Filed: Jul. 27, 2004

(65) Prior Publication Data

US 2006/0022823 A1 Feb. 2, 2006

(51) Int. Cl.
*G08B 13/14* (2006.01)

(52) U.S. Cl. ..... 340/572.1; 340/539.1; 340/825.69; 340/10.1

(58) Field of Classification Search .. 340/572.1–572.9, 340/505, 568.1, 539.1, 825.36, 10.1, 571, 340/825.69, 539.21, 10.4, 10.3, 10.42
See application file for complete search history.

(56) References Cited

U.S. PATENT DOCUMENTS 5,949,335 A 9/1999 Maynard
5,999,091 A * 12/1999 Wortham ..... 340/431
6,040,774 A * 3/2000 Schepps ..... 340/572.1
6,263,440 B1 7/2001 Pruett et al.
6,366,242 B1 * 4/2002 Boyd et al. ..... 342/450
6,593,885 B2 * 7/2003 Wisherd et al. ..... 342/463
6,609,656 B1 * 8/2003 Elledge ..... 235/382
6,681,989 B2 1/2004 Bodin
6,696,954 B2 2/2004 Chung
6,714,121 B1 3/2004 Moore
6,724,308 B2 * 4/2004 Nicholson ..... 340/572.1
6,734,797 B2 5/2004 Shanks et al.
6,784,789 B2 * 8/2004 Eroglu et al. ..... 340/10.6
6,967,563 B2 * 11/2005 Bormaster ..... 340/10.31
7,046,147 B2 * 5/2006 Stigall ..... 340/572.1

* cited by examiner

*Primary Examiner*—Daniel Wu
*Assistant Examiner*—Daniel Previl
(74) *Attorney, Agent, or Firm*—Crowell & Moring

(57) ABSTRACT

Disclosed are systems and methods for utilizing a plurality of RFID readers as proximity sensors to detect one or more RFID tagged assets. In one embodiment, an array of RFID readers provides a coverage area and polls one or more tagged assets at a predetermined interval. If a tagged asset is removed from the coverage area, it will not be able to respond to the next RFID-reader poll, thereby indicating that it has been removed from the coverage area. One or more of the RFID readers may then provide a notification of this fact. In another embodiment, one or more RFID readers operating in combination with one or more RFID tags can be used to detect whether expendable items should be replaced, or whether a device should be allowed to be activated.

24 Claims, 8 Drawing Sheets

SYSTEMS AND METHODS FOR ZONE SECURITY

FIELD OF THE INVENTION

The invention relates in general to systems and methods for radio frequency identification (RFID) zone security. In particular, the invention relates to using RFID readers as proximity sensors.

BACKGROUND

The possibility of theft is omnipresent and is often a resource-draining endeavor to prevent or at least minimize. Countless systems and techniques have been introduced to help businesses and individuals alleviate this constant nuisance. While such techniques have met with some success, it is generally the case that the more effective the counter-theft measure, the more expensive it will be as well. Depending on the value of the underlying asset, the costs sometimes dictate that only modest security measures be implemented. Similarly, while more effective security measures tend to be implemented for more valuable assets, these additional costs are typically passed on to the consumer level.

Another issue facing many businesses is the accidental misplacement of a mobile asset. Even though a mobile asset may not be stolen, its location may still be unknown to its owner. It may be difficult and time consuming to locate such an item. Thus, what is needed is an improved cost-effective technique that overcomes one or more of the aforementioned problems.

BRIEF SUMMARY OF THE INVENTION

Disclosed and claimed herein are systems and methods for RFID zone security. In one embodiment, the system comprises a radio frequency identification (RFID) tag affixed to an asset, and an RFID reader programmed to recognize an identification code of the RFID tag. In one embodiment, the RFID reader is to poll for the RFID tag at a predetermined time interval, and receive a response signal from the RFID tag when the asset is within a predetermined area. In addition, the RFID tag is to activate a notification device when the response signal is not received to indicate that the asset is not within the predetermined area.

Other aspects, features, and techniques of the invention will be apparent to one skilled in the relevant art in view of the following detailed description of the invention.

DETAILED DESCRIPTION OF THE PREFERRED EMBODIMENT

Figure 1:
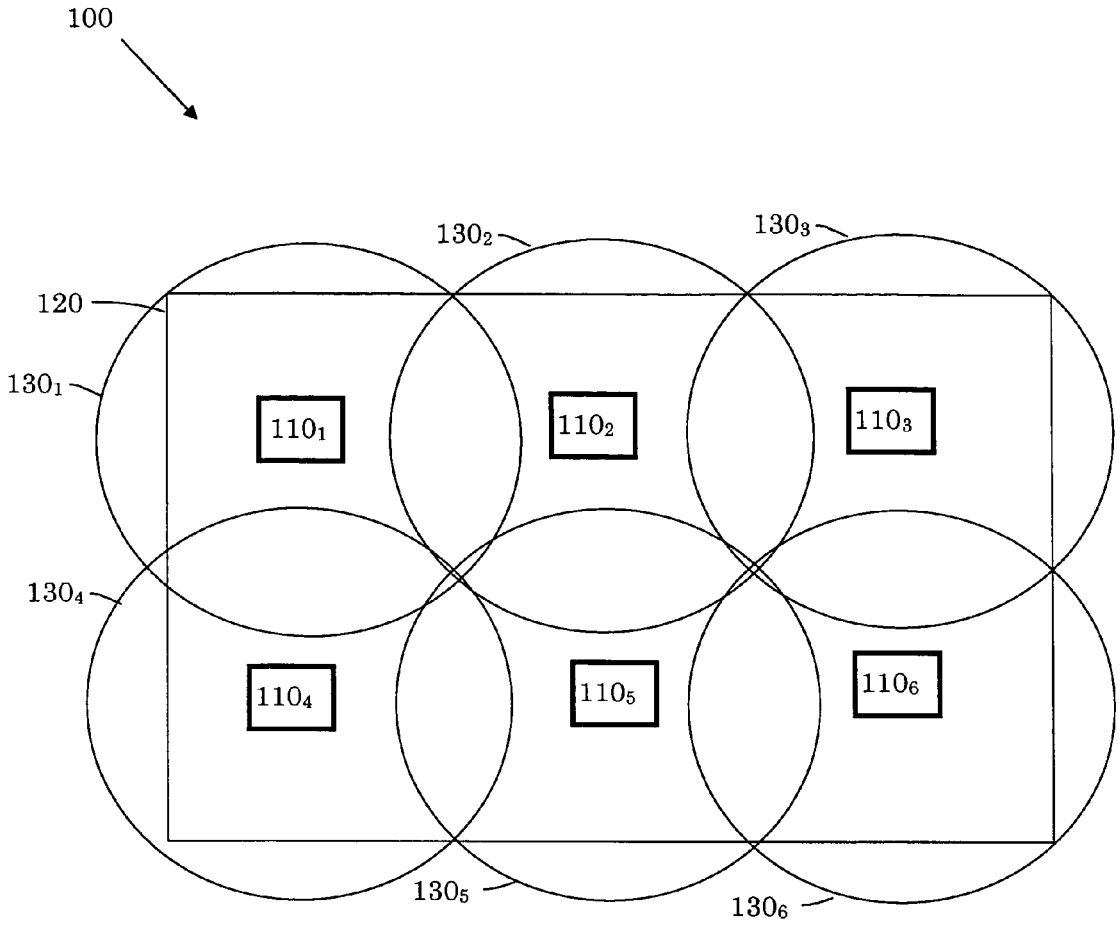
FIG. 1 is a simplified diagram showing proximity security coverage, according to one embodiment of the invention.

RFID technology uses electromagnetic energy as a medium for transmitting information between a transmitter, typically referred to as a "reader," and a receiver which is typically referred to as a "tag." RFID tags can be either passive or active. Passive tags do not have a separate power source and often use modulated backscatter to reflect energy back to the reader. Other types of passive tags may discharge a capacitor that was charged using the RF energy from a reader's ping. Active tags, on the other hand, have power sources that enable the tag to send data back to the reader and over a larger range than passive tags.

One aspect of the invention is to utilize a plurality of RFID readers as proximity sensors to detect one or more RFID tagged assets. In one embodiment, an array of RFID readers provides a coverage area and pings/polls one or more tagged assets at a predetermined interval. If a tagged asset is removed from the coverage area, it will not be able to respond to the next RFID-reader ping or poll, thereby indicating that it has been removed from the coverage area. One or more of the RFID readers may then provide a notification of this fact. In another embodiment, the array of RFID readers can be used to detect where, within the coverage area, a particular asset is located. In this manner, stolen or misplaced items can be quickly and cost-effectively detected and reported.

Another aspect of the invention is to use an RFID reader/tag system to keep track of items which require periodic replacement. In one embodiment, replacement items may be tagged and pinged/polled by an RFID reader at regular intervals. Once a replacement period has lapsed, each time the RFID reader pings the tagged item, a user may be notified that the tagged item should be replaced. In one embodiment, this may continue until the tagged item is removed from the RFID reader's range (i.e., replaced). It should equally be appreciated that the user may only be notified once, or some other subset of the number of times the lapsed item is pinged or polled and still responds.

Yet another aspect of the invention is to alert a user when a mobile object, such as a piece of luggage, has been removed from the user's possession. When the mobile object is tagged with an RFID tag, the user may use a mobile RFID reader to regularly poll for the tagged item. If the RFID reader does not receive a response, the user may be alerted that the tagged item has been removed from the user's possession. In one embodiment, the RFID reader may be incorporated into a cell phone, PDA, etc.

Still another aspect of the invention is to use a combination of an RFID reader and serialized tag to authorize the activation of a device, such as an automobile. In one embodiment, the serialized tag may be attached to a portable object, such as a key ring, keyless entry transmitter, a wallet, etc. An RFID reader may then be programmed with the serialized tag and coupled to a device that is to be activated. While in one embodiment, the device is an automobile, it should similarly be appreciated that the device may be a personal computer, PDA, cell phone, or any other device capable of being electronically activated.

FIG. 1 is a schematic of a system 100 for one embodiment of RFID zone security. In the embodiment of FIG. 1, a plurality of RFID readers $\mathbf{110}_1$–$\mathbf{110}_6$ are used as proximity sensors to detect the presence of one or more recognized RFID tags (not shown) within a predetermine area 120. It should be appreciated that more or fewer RFID readers may be used to cover the area 120, and that the RFID readers may have any number of orientations. In this embodiment, RFID readers $\mathbf{110}_1$–$\mathbf{110}_6$ emit RF signals having an approximate range $\mathbf{130}_1$–$\mathbf{130}_6$.

As shown in FIG. 1, the ranges $\mathbf{130}_1$–$\mathbf{130}_6$ may overlap to enable the system 100 to accurately indicate when a recognized RFID tags leaves the area 120. As will be described in more detail below, RFID tags become "recognized RFID tags" once they are serialized and programmed into the system 100. RFID readers $\mathbf{110}_1$–$\mathbf{110}_6$ may then ping/poll for recognized RFID tags to ensure that they are still within area 120. If a recognized RFID tag is removed from the area 120, system 100 will detect this fact the next time the tags are pinged or polled. In one embodiment, an alarm or other signal may be triggered upon detecting that an RFID tag has been removed from the area 120.

Figure 2:
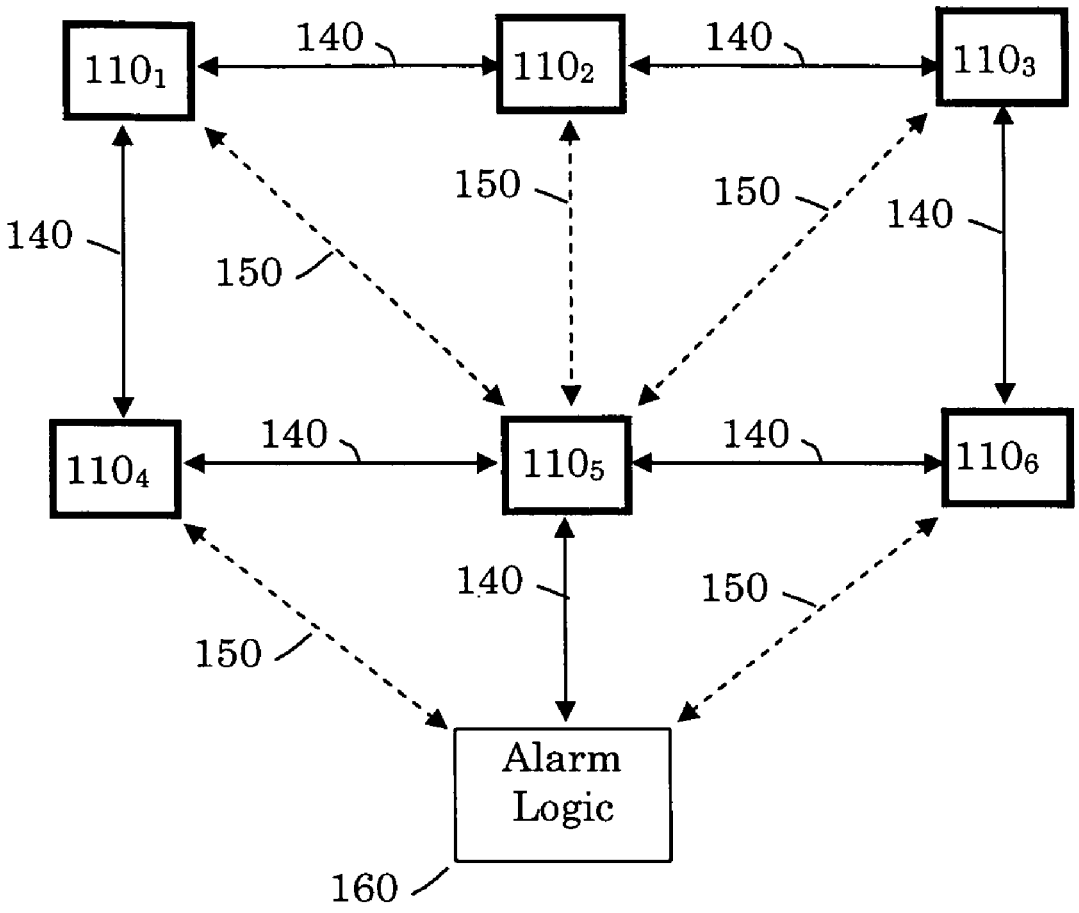
FIG. 2 is a simplified diagram showing the interconnectivity of a plurality of RFID readers, provided in accordance with the principles of the invention.

FIG. 2 is a simplified diagram of how the RFID readers $\mathbf{110}_1$–$\mathbf{110}_6$ of FIG. 1 may be interconnected. In this embodiment, RFID readers $\mathbf{110}_1$–$\mathbf{110}_6$ are connected over communication links 140. It should be appreciated that communication links 140 may include, but not be limited to, a telephone line, an Integrated Services Digital Network (ISDN) connection, an Asynchronous Transfer Mode (ATM) connection, a frame relay connection, an Ethernet connection, a coaxial connection, a fiber optic connection, etc. In the embodiment of FIG. 2, each of the RFID readers $\mathbf{110}_1$–$\mathbf{110}_6$ are shown as being connected to one other RFID reader by communication links 140. In addition, the RFID readers $\mathbf{110}_1$–$\mathbf{110}_6$ may be optionally connected to additional RFID readers over optional communication links 150.

FIG. 2 further depicts alarm logic 160 connected to the RFID readers $\mathbf{110}_1$–$\mathbf{110}_6$ via one of the communication links 140 and the optional communication links 150. In one embodiment, the RFID readers $\mathbf{110}_1$–$\mathbf{110}_6$ send out a ping/poll for recognized RFID tags (not shown). The RFID tags may then respond to the ping/poll which will be detected by one of the RFID readers $\mathbf{110}_1$–$\mathbf{110}_6$ so long as the tag(s) in question are within the detection area of the RFID readers $\mathbf{110}_1$–$\mathbf{110}_6$ (e.g., area 120). So long as at least one of the RFID readers $\mathbf{110}_1$–$\mathbf{110}_6$ detects the RFID tag's response, this information can be communicated to the other RFID readers $\mathbf{110}_1$–$\mathbf{110}_6$ readers. If, on the other hand, a recognized tag moves out of the detection area, and none of the RFID readers $\mathbf{110}_1$–$\mathbf{110}_6$ detect an expected response, this information may be communicated to alarm logic 160 which may in turn provide a notification that at least one of the recognized tags have moved out of the area. In one embodiment, this notification may be an alarm or other audible sound, and/or a visual indication.

Another aspect of the invention is to enable the location of misplaced recognized tags. Namely, the response received from a ping or poll by the RFID readers $\mathbf{110}_1$–$\mathbf{110}_6$, can be used to identify in which of the ranges $\mathbf{130}_1$–$\mathbf{130}_6$ a particular asset is located. This information may then be communicated to a central processing system or the like.

Figure 3:
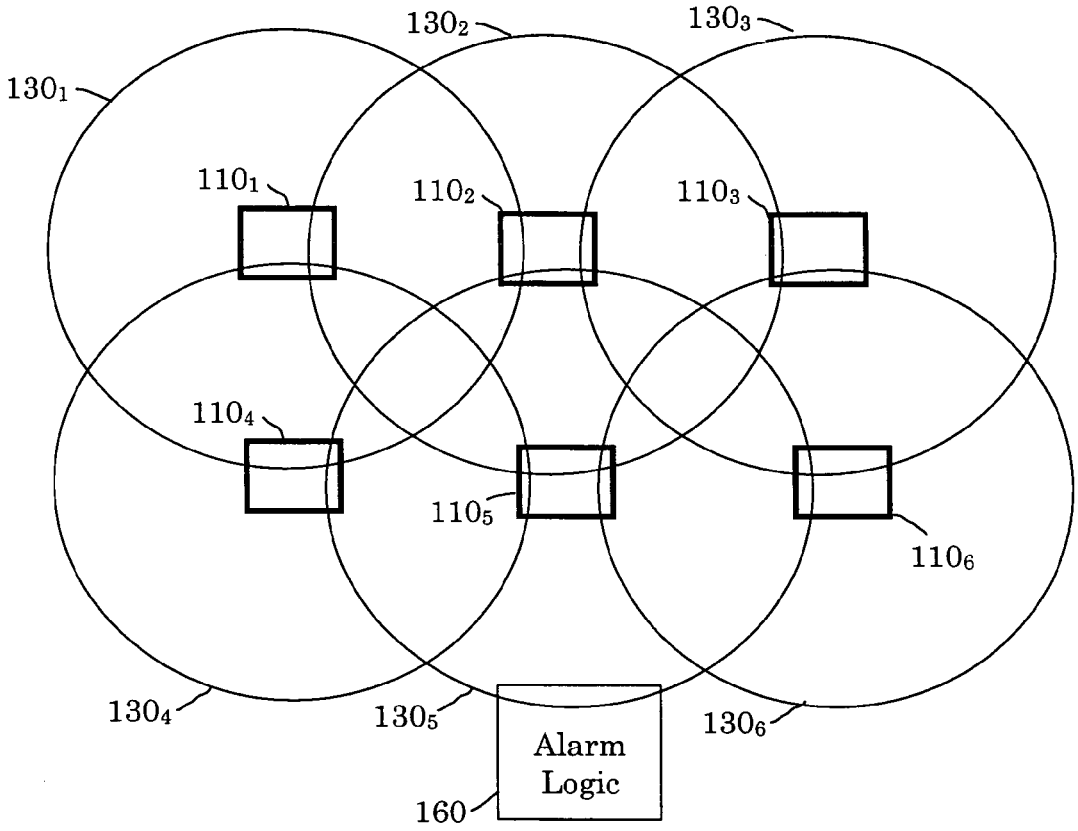
FIG. 3 is another embodiment of a diagram showing the interconnectivity of the plurality of RFID readers of FIG. 2.

FIG. 3 is another embodiment of a simplified diagram depicting how the RFID readers $\mathbf{110}_1$–$\mathbf{110}_6$ of FIG. 1 may be interconnected. In this embodiment, no communication links 140 or optional communication links 150 are needed. Rather, RFID readers $\mathbf{110}_1$–$\mathbf{110}_6$ are able to wirelessly communicate with each other and with alarm logic 160. Specifically, each of the RFID readers $\mathbf{110}_1$–$\mathbf{110}_6$ is within the range $\mathbf{130}_1$–$\mathbf{130}_6$ of one or more of the other RFID readers $\mathbf{110}_1$–$\mathbf{110}_6$. This enables the RFID readers $\mathbf{110}_1$–$\mathbf{110}_6$ to wirelessly communicate with each other, as well as with alarm logic 160. In one embodiment, wireless communication includes radio frequency, but may similarly include other known wireless technologies (e.g., spread spectrum).

Figure 4A:
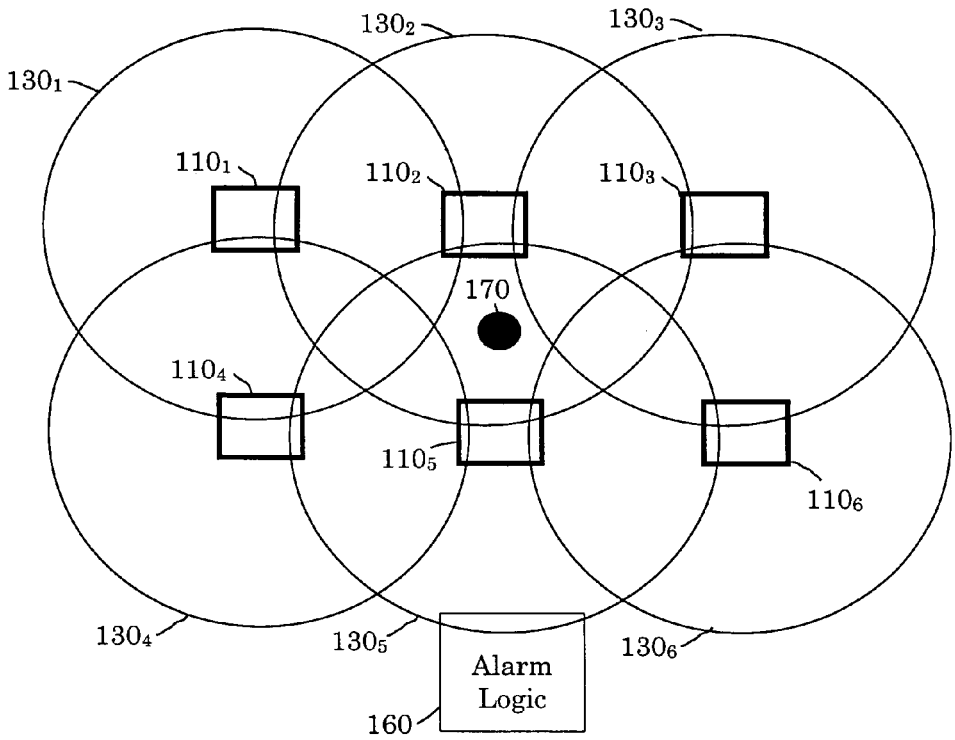
FIG. 4A-4B are additional embodiments of diagrams depicting the interconnectivity of a plurality of RFID readers with an RFID tag, according to the principles of the invention.
Figure 4B:
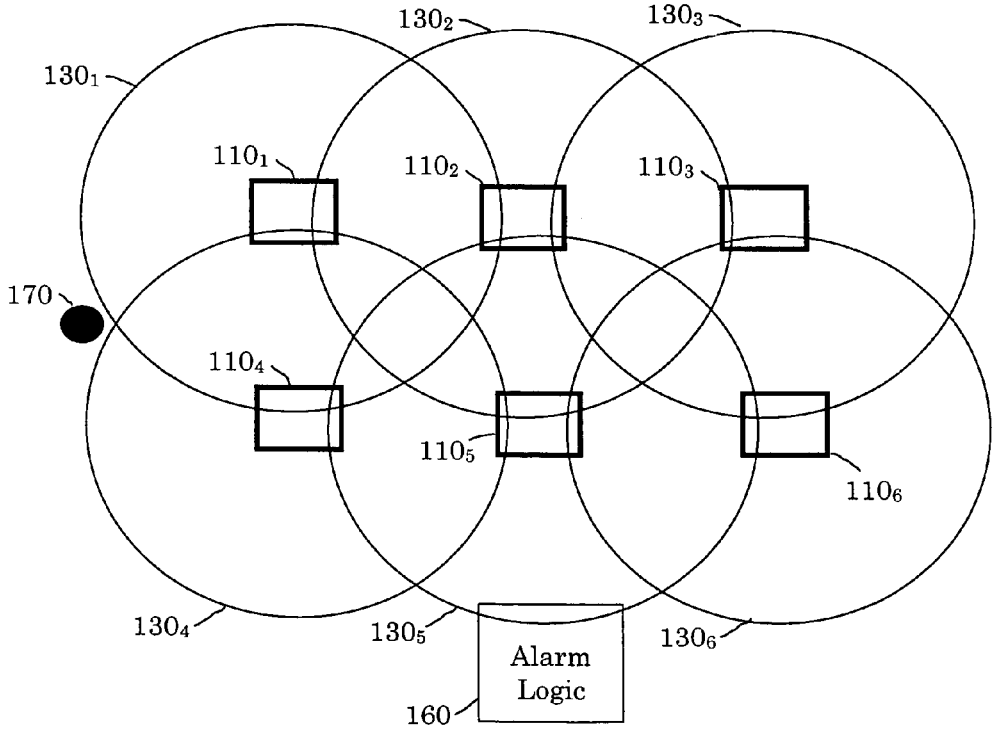

FIGS. 4A–4B depict additional embodiments of the diagram of FIG. 3. In the embodiment of FIG. 4A, a recognized RFID tag 170 is oriented within the range $\mathbf{130}_1$–$\mathbf{130}_6$ of the RFID readers $\mathbf{110}_1$–$\mathbf{110}_6$. As mentioned above, RFID readers $\mathbf{110}_1$–$\mathbf{110}_6$ may ping/poll the tag 170 at regular intervals. So long as the tag 170 is within the range $\mathbf{130}_1$–$\mathbf{130}_6$ of at least one RFID reader $\mathbf{110}_1$–$\mathbf{110}_6$, the tag's 170 response will be detected and alarm logic 160 will not be triggered. It should be appreciated that the tag's 170 response may be backscatter or energy from a discharged capacitor, where the tag 170 is a passive tag. Alternatively, if tag 170 is an active tag its response may comprise additional data transmitted over radio frequencies. In either case, RFID readers $\mathbf{110}_1$–$\mathbf{110}_6$ may communicate with each other after each ping to verify that all recognized RFID tags (e.g., tag 170) are within range of at least one of the RFID readers $\mathbf{110}_1$–$\mathbf{110}_6$.

FIG. 4B depicts the diagram of FIG. 4A after the recognized tag 170 is removed from the coverage area of the RFID readers $\mathbf{110}_1$–$\mathbf{110}_6$. At this point, the next time the RFID readers $\mathbf{110}_1$–$\mathbf{110}_6$ ping or poll the tag 170, there won't be a response. This lack of a response will indicate to the system that the tag 170 has been removed. In one embodiment, alarm logic 170 may be activated as an indication that the tag 170 has been removed from a designated area without authorization.

Figure 5:
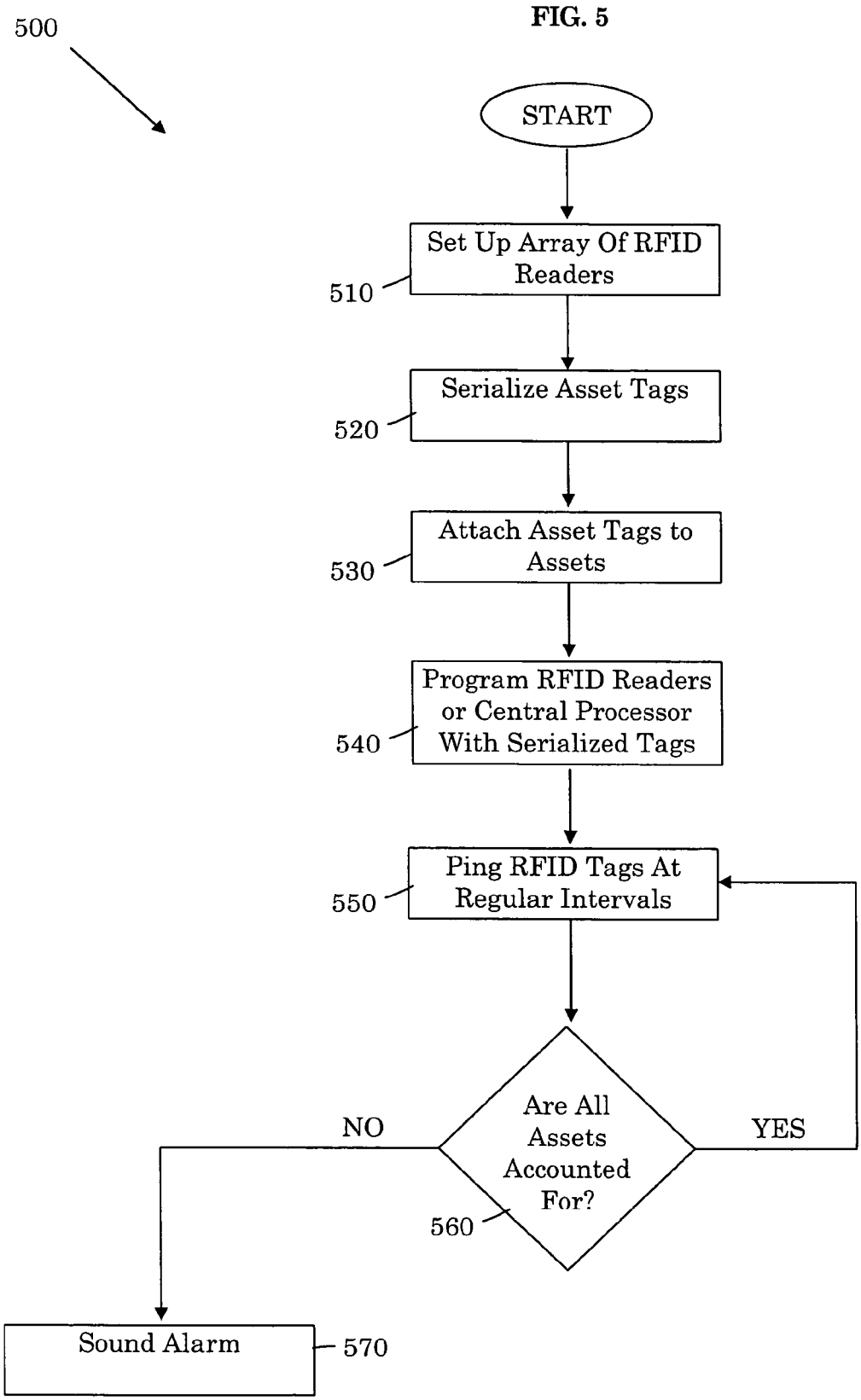
FIG. 5 is a flow diagram illustrating one embodiment of a process for utilizing a plurality of RFID readers as proximity sensors.

Referring now to FIG. 5, a flow diagram illustrating one embodiment of a process for utilizing a plurality of RFID readers as proximity sensors is provided. In particular, process 500 begins at block 510 with an array of RFID readers (e.g., RFID readers $\mathbf{110}_1$–$\mathbf{110}_6$) being positioned and oriented to cover a predetermined area (e.g., area 120). In one embodiment, the signal ranges (e.g., ranges $\mathbf{130}_1$–$\mathbf{130}_6$) of the RFID readers overlap such that any recognized/serialized RFID tags within the predetermined area will be properly detected.

Once the RFID reader array is set up, one or more asset tags may be serialized (block 520) and attached to corresponding assets (block 530). Serialized asset tags are those tags which have been assigned an identification code, or other identifying information which is provided to an RFID reader when requested. In addition, it should be appreciated that RFID tags may be attached to an asset using any number of techniques, some being more secure than others. However, by fixedly attaching an RFID tag to an asset, the location of the asset can be monitored by pinging/polling the attached RFID tag.

Either before or after the asset tags are attached, process 500 continues to block 540 where the array of RFID readers is programmed with the serialized tags. While in one embodiment, each individual RFID reader is programmed with the serialized tags, in another embodiment a central processor, which is in communication with the array of RFID readers, may be programmed with the serialized tags. In yet another embodiment, or in addition to the previous embodiments, the array of RFID readers or the central processor are programmed with an identification code for each serialized RFID tag. However, it should be appreciated that the RFID reader or the central processor may similarly be programmed with additional information relating to the serialized RFID tags.

Once the serialized tags are attached to the assets of interest and programmed into the array of RFID readers, the RFID readers may ping or poll the serialized RFID tags at regular intervals (block 550). Depending on the type of RFID tags used, the signal sent by the tags in response to the reader poll may be backscatter (in the case of passive tags) or an RF signal (in the case of an active tag). Regardless of the type of RFID tags used or the signal generated, the RFID tags should be able to communicate back to the RFID readers some form of information which identifies the tag in question and indicates that it is still in range of at least one of the RFID readers.

After the array of RFID readers has pinged the serialized tags, process 500 moves to block 560 where a determination can be made as to whether all of the tagged assets are accounted for. In one embodiment, this is done by comparing the responses received from the RFID tags within range to the list of recognized tags that were programmed into the reader array at block 540. If all tags are accounted for, then process 500 returns to block 550 where the asset tags can be polled again after the predetermined interval of time lapses. If, on the other hand, one or more of the assets are not accounted for (i.e., no response is detected by at least one of the RFID readers in the array), then process 500 moves to block 570 where an alarm may be sounded. Rather than sounding an alarm, it should equally be appreciated that other forms of notification may similarly be used (e.g., visual notification, other audible notification, etc.).

Figure 6:
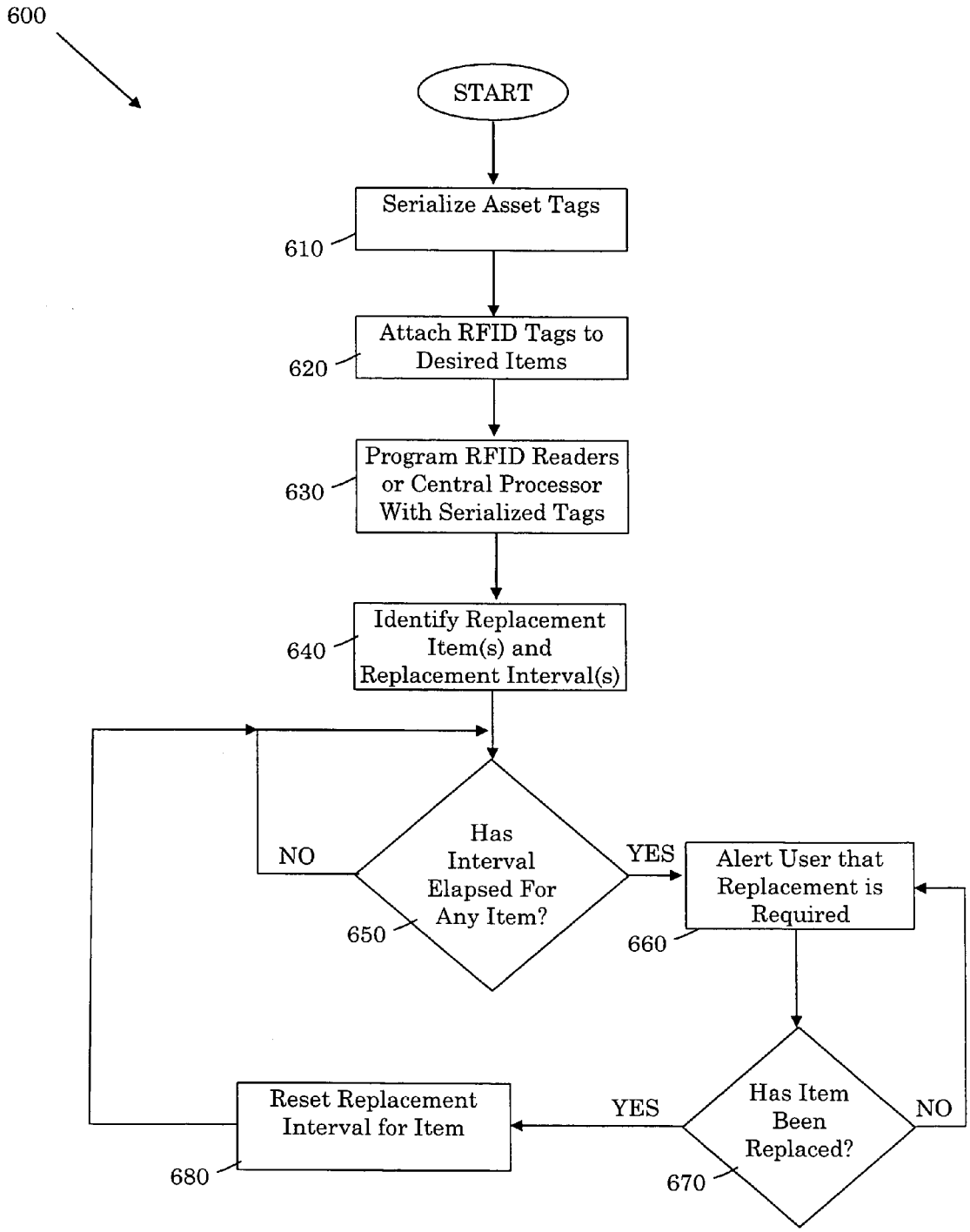
FIG. 6 is a flow diagram illustrating another embodiment of a process for utilizing a plurality of RFID readers as proximity sensors.

Referring now to FIG. 6, depicted is a flow diagram illustrating another embodiment of a process for utilizing a plurality of RFID readers as proximity sensors. In this embodiment, RFID tags are used to keep track of items which require periodic replacement. Process 600 begins with the asset tags being serialized (block 610) and attached to desired items (block 620). Thereafter, at block 630, an RFID reader or central processor is programmed with the serialized tags. While in one embodiment, one or more RFID readers may be programmed with the serialized tags, in another embodiment a central processor, which is in communication with at least one RFID reader, may be programmed with the serialized tags. In yet another embodiment, or in addition to the previous embodiments, the RFID reader(s) or central processor may be programmed with an identification code for each serialized RFID tag. However, it should be appreciated that the RFID reader(s) or the central processor may similarly be programmed with additional information relating to the serialized RFID tags.

Process 600 continues with block 640 where a user can identify one or more items for replacement, as well as the time period for when the replacement should occur. For example, in one embodiment a user may identify the water filter in a refrigerator for replacement in 3 months. Similarly, batteries in a smoke detector may be designated for replacement every 12 months. In this case, an RFID tag may be serialized (block 610) and attached to the water filter and/or batteries (block 620). Thereafter, the RFID reader(s) may be programmed with the serialized tags for the water filter and/or batteries (block 30). Then, at block 640, the tagged water filter and/or batteries may be identified as replacement items and the replacement interval designated (i.e., 3 months and 12 months, respectively). In one embodiment, this information may be provided to and stored by a processing unit (e.g., personal computer, PDA, etc.). In another embodiment, or in addition to the previous embodiments, the processing unit is in communication with the RFID reader which was previously programmed with the serialized water filter tag.

Once the replacement items have been designated and the replacement time periods established, process 600 may continue to block 650 where a determination is made as to whether any replacement interval has lapsed. In one embodiment, this may be accomplished by having the processing unit periodically review a database of replacement items to see if any of the replacement intervals has lapsed. However, it should equally be understood that numerous other methods of determining that a replacement interval has lapsed may be used.

If a determination is made at block 650 that none of the previously-defined replacement intervals has lapsed, process 600 may continue to periodically review the list of replacement items to see if any of the replacement intervals has lapsed. If, on the other hand, a determination is made at block 650 that at least one of the replacement intervals has lapsed, process 600 will alert the user of this fact (block 660). In one embodiment, the processing unit may alert a user using a visual notification on a display screen or an audible notification. In another embodiment, the processing unit may communicate with another device (e.g., television) to provide the user with such notification. It should be appreciated that numerous means for notifying a user of the lapsing of a replacement interval may be apparent to one skilled in the art.

Once the user has been alerted to the fact that replacement is required for one of the designated items, a determination may then be made whether the item in question has been replaced (block 670). In one embodiment, this determination is made by polling the serialized tag of the item to be replaced. If the RFID reader detects a response from the tagged item, then this is an indication that the tagged item is still in the area and has not been replaced. If a past-due item has not been replaced, then process 600 will return to block 660 where the user will again be alerted of the lapsed replacement interval. In one embodiment, the user is periodically (e.g., once an hour, once a day, once a week, etc.) alerted of the past-due replacement item until the tagged replacement item is polled and no response is received. In that case, process 600 will continue to block 680 where the replacement interval is reset for the item and the process 500 returns to monitoring whether any replacement intervals have lapsed.

Figure 7:
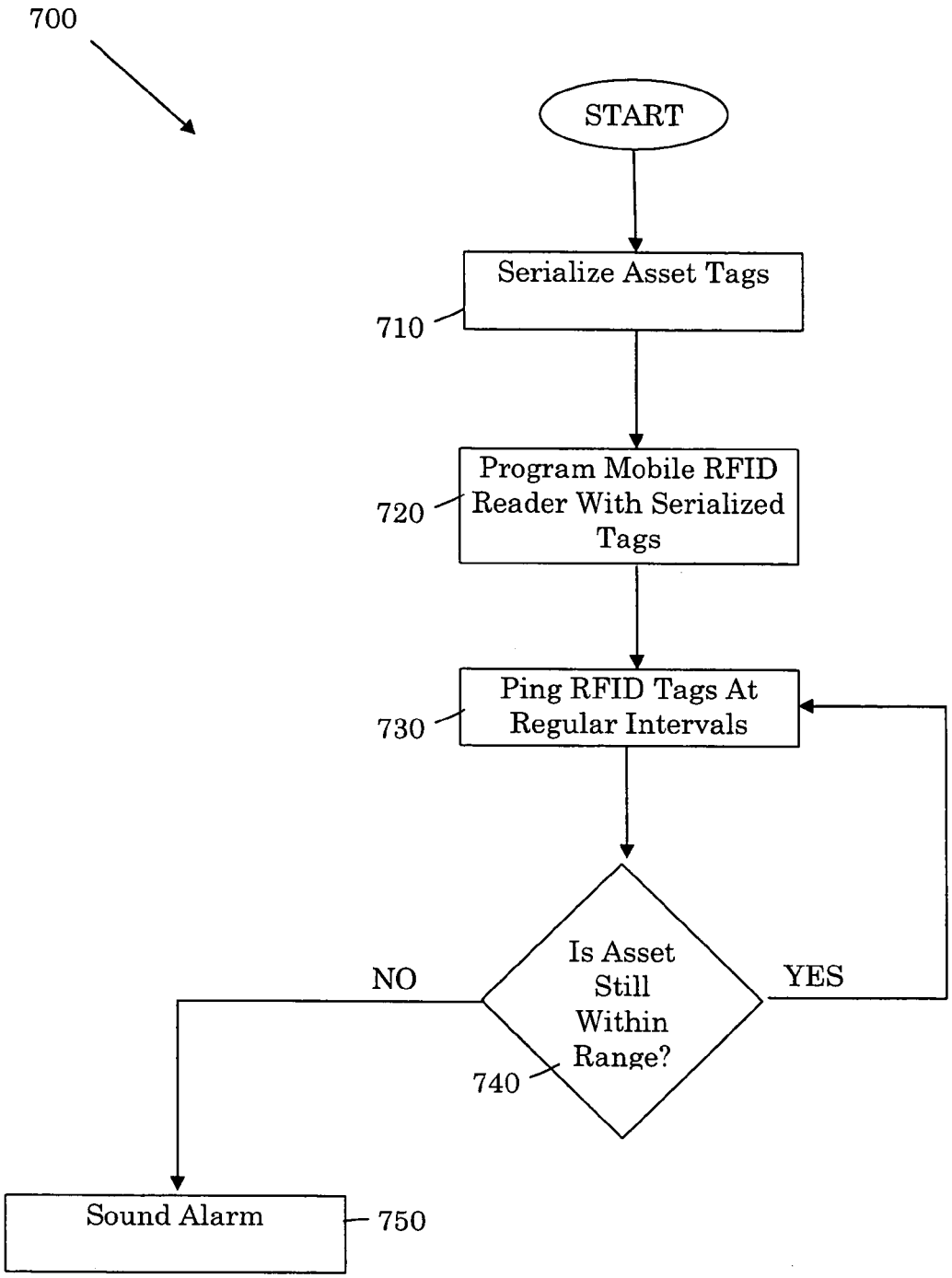
FIG. 7 is a flow diagram illustrating yet another embodiment of a process for utilizing an RFID reader as a proximity sensor.

Referring now to FIG. 7, depicted is a flow diagram illustrating another embodiment of a process for using an RFID reader as a proximity sensor. In this embodiment, a mobile RFID reader(s) is used to detect when a tagged asset is removed from the reader's range. For example, in one embodiment, an RFID reader can be incorporated into a cellular phone, PDA or the like. A tagged asset, such as a piece of luggage, can then be pinged/polled by the RFID reader to detect if the luggage has been removed from the owner's possession. Process 700 begins with one or more asset tags being serialized and attached to corresponding assets (e.g., a piece of luggage, handbag, wallet, etc.) (block 710). Either before or after the asset tag(s) are attached, process 700 continues to block 720 where the mobile RFID reader is programmed with the serialized asset tags.

Once the serialized tag(s) are attached to the asset(s) of interest and programmed into the mobile RFID reader, the RFID reader may poll the serialized RFID tag(s) at regular intervals (block 730). As discussed above, depending on the type of RFID tag(s) used, the signal sent by the tags in response to the reader pings may be backscatter (in the case of passive tags) or an RF signal (in the case of an active tag). Regardless of the type of asset tag(s) used or the signal generated, the RFID tag(s) should be able to communicate back to the mobile RFID reader some form of information which identifies the tag in question and indicates that it is still in range of the mobile RFID readers.

After the mobile RFID reader has polled the serialized tag(s), process 700 moves to block 740 where a determination can be made as to whether all of tagged asset(s) are still within range of the mobile reader. In one embodiment, this is done by comparing the responses received from the RFID tag(s) within range to a list of the recognized tags that were programmed into the mobile reader at block 720. If all previously-programmed tags are accounted for, then process 700 returns to block 730 where the asset tag(s) can again be polled after a predetermined interval of time lapses. If, on the other hand, one or more of the assets are not accounted for (i.e., no response is detected from at least one of the RFID readers), then process 700 moves to block 750 where an alarm may be sounded and the owner alerted to the fact that an asset has been removed from his possession. Rather than sounding an alarm, it should equally be appreciated that other forms of notification may similarly be used (e.g., visual notification, other audible notification, etc.).

Figure 8:
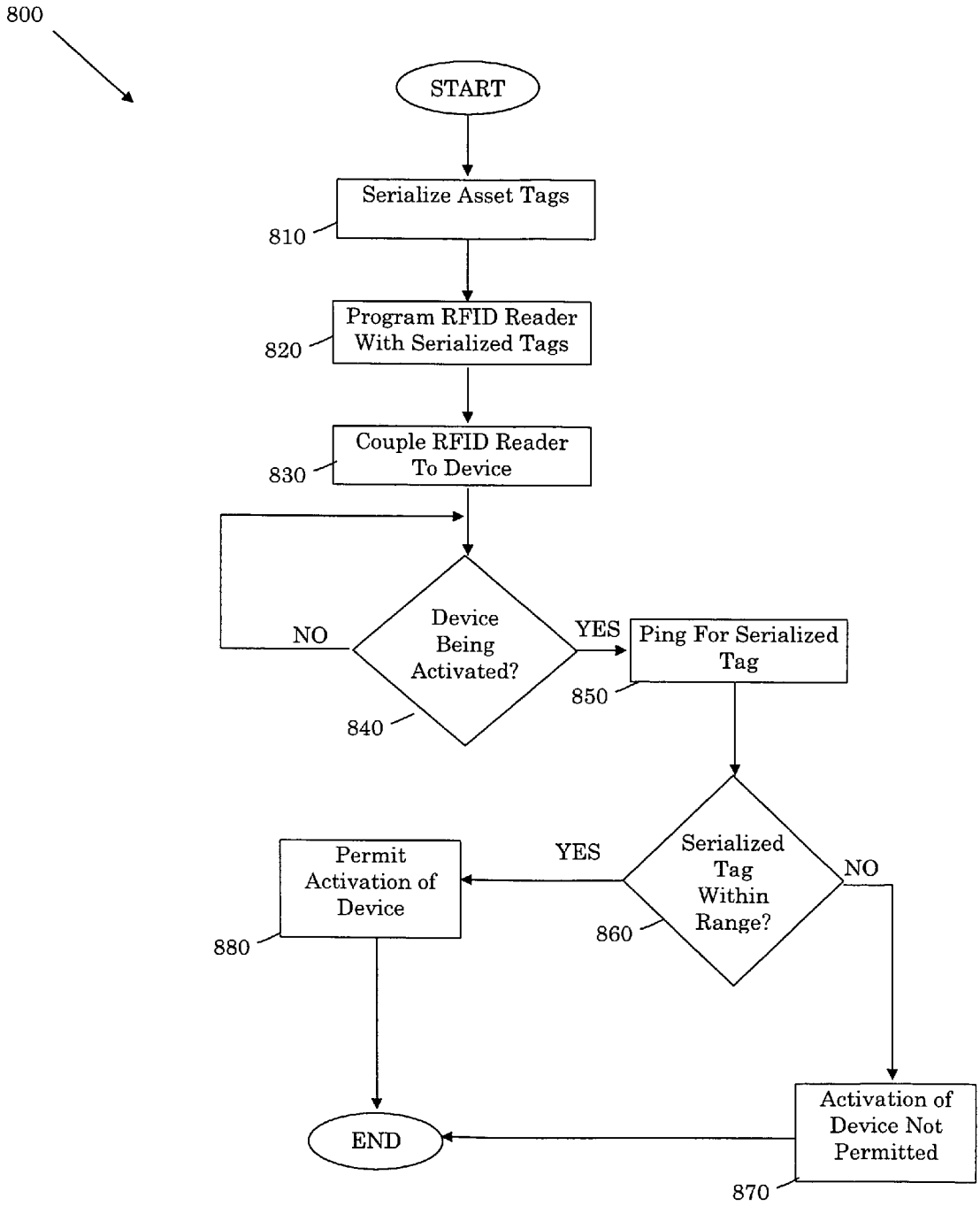
FIG. 8 is a flow diagram illustrating yet another embodiment of a process for utilizing an RFID reader as a proximity sensor.

FIG. 8 depicts yet another embodiment of a process for utilizing an RFID reader as a proximity sensor. However, in this embodiment an RFID reader and serialized tag may be used in combination to authorize the activation of a device, such as an automobile. In one embodiment, the serialized tag may be attached to a portable object, such as a key ring, keyless entry transmitter, a wallet, etc. An RFID reader may then be programmed with the serialized tag and coupled to a device that is to be activated. While in one embodiment, the device is an automobile, it should similarly be appreciated that the device may be a personal computer, PDA, cell phone, or any other device capable of being electronically activated.

As with previously embodiments, process 800 begins with one or more asset tag(s) being serialized (block 810). The RFID reader may then be programmed with the serialized tag(s) at block 820, and coupled to the device in question at block 830. In one embodiment, the RFID reader is coupled to an activation mechanism for the device (e.g., a vehicle's starter). It should be appreciated that numerous configurations for coupling the RFID reader to the device are possible, and that the RFID reader need only be configured to be able to prevent or allow the device's activation.

At this point in process 800, a determination may be made as to whether someone is attempting to activate the device (block 840). If not, process 800 will loop back to continue monitoring whether the device is attempting to be activated. If, on the other hand, someone is attempting to activate the device, the RFID reader will poll for the serialize tag with which it was previously programmed. If the serialized tag is not within range, the RFID reader will not detect a response and the attempted activation will be deemed unauthorized. Process 800 will continue to block 870 where the attempted activation will not be permitted. If, on the other hand, the RFID reader does receive a response from the serialized tag to the poll, this will indicate that the attempted activation is authorized and, as such, will be permitted (block 880).

While the preceding description has been directed to particular embodiments, it is understood that those skilled in the art may conceive modifications and/or variations to the specific embodiments described herein. Any such modifications or variations which fall within the purview of this description are intended to be included herein as well. It is understood that the description herein is intended to be illustrative only and is not intended to limit the scope of the invention.

What is claimed is:

1. A system comprising:

a radio frequency identification (RFID) tag affixed to an asset, said RFID tag having an identification code stored therein; and a plurality of RFID readers in communication with each other and programmed to recognize said identification code, wherein the plurality of RFID readers are configured to, poll for said RFID tag at a predetermined time interval, receive a response signal from the RFID tag when the asset is within a predetermined area, said response signal to include said identification code, and activate a notification device to indicate that the asset is not within said predetermined area when said response signal is not received.

2. The system of claim 1, wherein said response signal is in the form of one of backscatter, energy from a discharged capacitor and a radio frequency response signal.

3. The system of claim 1, wherein said RFID reader polls said RFID tag by emitting a radio frequency signal which triggers said response signal from said RFID tag.

4. The system of claim 3, wherein said response signal is validated by said RFID reader by comparing the identification code in the response signal with a programmed value.

5. The system of claim 1, further comprising a central processor coupled to the plurality of RFID readers and said notification device, wherein said plurality of RFID readers are to poll the RFID tag at the predetermined time interval, and wherein said central processor is to activate said notification device only when none of said plurality of RFID readers detect the response signal from the RFID tag.

6. The system of claim 5, further comprising a plurality of RFID tags, said plurality of RFID readers being programmed to recognize a plurality of identification codes that are associated with said plurality of RFID tags.

7. A method comprising:

serializing a radio frequency identification (RFID) tag, said RFID tag having an identification code stored therein;

affixing the RFID tag to an asset;

programming a plurality of RFID readers in communication with each other to recognize said identification code;

polling said RFID tag at a predetermined time interval;

receiving a response signal, by one or more of the plurality of RFID readers, from the RFID tag when the asset is within a predetermined area, said response signal to include said identification code; and providing a notification when said response signal is not received, where said notification indicates that the asset is not within the predetermined area.

8. The method of claim 7, wherein receiving the response signal comprises receiving the response signal from the RFID tag when the asset is within a predetermined area, where said response signal is in the form of one of backscatter, energy from a discharged capacitor and a radio frequency response signal.

9. The method of claim 7, wherein polling said RFID tag comprises polling said RFID tag by emitting a radio frequency signal which triggers said response signal.

10. The method of claim 7, further comprising validating said response signal comparing the identification code in the response signal with a programmed value in the RFID reader.

11. The method of claim 7, wherein said polling comprises polling said RFID tag by said plurality of RFID readers at the predetermined time interval, the method further comprising providing said notification when none of said plurality of RFID readers detects the response signal from the RFID tag.

12. The method of claim 11, further comprising programming said plurality of RFID readers to recognize a plurality of identification codes that are associated with a plurality of RFID tags.

13. A system comprising:

a radio frequency identification (RFID) tag having an identification code stored therein;

an activation device; and an RFID reader coupled to the activation device, the RFID reader being programmed to recognize said identification code, said RFID reader to, detect an attempt to activate said activation device, poll, in response to said attempt to activate the activation device, said RFID tag, receive a response signal from the RFID tag when the RFID tag is within a predetermined area, said response signal to include said identification code, and permit the activation of said activation device in response to receiving said response signal.

14. The system of claim 13, wherein said response signal is in the form of one of backscatter, energy from a discharged capacitor and a radio frequency response signal.

15. The system of claim 13, wherein said RFID reader polls said RFID tag by emitting a radio frequency signal which triggers said response signal from said RFID tag.

16. The system of claim 13, wherein said response signal is validated by said RFID reader by comparing the identification code in the response signal with a programmed value.

17. A method comprising:

programming a radio frequency identification (RFID) reader to recognize an identification code of an RFID tag;

detecting an attempt to activate an activation device;

polling, in response to said attempt, said RFID tag;

receiving a response signal from the RFID tag when the RFID tag is within a predetermined area, said response signal to include said identification code; and permitting the activation of said activation device in response to receiving said response signal.

18. The method of claim 17, wherein receiving said response signal comprises receiving said response signal from the RFID tag when the RFID tag is within the predetermined area, and wherein said response signal is in the form of one of backscatter, energy from a discharged capacitor and a radio frequency response signal.

19. The method of claim 17, wherein said polling comprises polling, in response to said attempt, said RFID tag by emitting a radio frequency signal which triggers said response signal from said RFID tag.

20. The method of claim 17, further comprising validating said response signal by comparing the identification code in the response signal with a programmed value in the RFID reader.

21. A system comprising:

a radio frequency identification (RFID) tag affixed to a replaceable item that is designated to be replaced after a predetermined period of time, said RFID tag having an identification code stored therein; and an RFID reader programmed to recognize said identification code, said RFID reader to, poll for said RFID tag after said predetermined period of time has elapsed, receive a response signal from the RFID tag indicating that the replaceable item has not been replaced, said response signal to include said identification code, and activate a notification device to indicate that the replaceable item should now be replaced.

22. The system of claim 21, wherein said RFID reader is further to continue to poll said RFID tag and to activate the notification device to indicate that the replaceable item should be replaced until said response signal is no longer received in response to the RFID reader polling the RFID tag.

23. A method comprising:

serializing a radio frequency identification (RFID) tag, said RFID tag having an identification code stored therein;

affixing the RFID tag to a replaceable item that is designated to be replaced after a predetermined period of time;

programming an RFID reader to recognize said identification code;

polling said RFID tag after said predetermined period of time has elapsed;

receiving a response signal from the RFID tag indicating that the replaceable item has not been replaced, said response signal to include said identification code; and activating a notification device to indicate that the replaceable item should now be replaced.

24. The method of claim 23, further comprising polling, periodically, said RFID tag after the predetermined period of time until said response signal is no longer received in response to said polling indicating that said replaceable item has been replaced.

* * * * *